US006576893B1

(12) United States Patent
Kawato et al.

(10) Patent No.: US 6,576,893 B1
(45) Date of Patent: Jun. 10, 2003

(54) METHOD OF TRAPPING IONS IN AN ION TRAPPING DEVICE

(75) Inventors: Eizo Kawato, Cheadle (GB); Alan Joseph Smith, Manchester (GB)

(73) Assignee: Shimadzu Research Laboratory, (Europe), Ltd., Manchester (GB)

( * ) Notice: Subject to any disclaimer, the term of this patent is extended or adjusted under 35 U.S.C. 154(b) by 0 days.

(21) Appl. No.: 09/530,092

(22) PCT Filed: Jan. 12, 1999

(86) PCT No.: PCT/GB99/00083

§ 371 (c)(1),
(2), (4) Date: Aug. 8, 2000

(87) PCT Pub. No.: WO99/39370

PCT Pub. Date: Aug. 5, 1999

(30) Foreign Application Priority Data

Jan. 30, 1998 (GB) ..... 9802112

(51) Int. Cl.[7] ..... H01J 49/00
(52) U.S. Cl. ..... 250/281; 250/288
(58) Field of Search ..... 250/290, 281, 250/288, 396 R

(56) References Cited

U.S. PATENT DOCUMENTS 2,939,952 A 6/1960 Paul et al. ..... 250/41.9
3,527,939 A * 9/1970 Dawson et al. ..... 250/281
5,396,064 A * 3/1995 Wells ..... 250/282
5,399,857 A 3/1995 Doroshenko et al. ..... 250/292
5,420,425 A * 5/1995 Bier et al. ..... 250/282
5,650,617 A 7/1997 Mordehai ..... 250/290
5,793,038 A * 8/1998 Buttrill, Jr. ..... 250/282

OTHER PUBLICATIONS

March and Hughes, "Quadrupole Storage Mass Spectrometry," pp. 76–78, John Wiley & Sons (1989).

* cited by examiner

*Primary Examiner*—John R. Lee
*Assistant Examiner*—K Fernandez
(74) *Attorney, Agent, or Firm*—Leydig, Voit & Mayer, Ltd.

(57) ABSTRACT

A quadrupole ion trapping device has a ring electrode (11) and two end-cap electrodes (12, 13). Ions are introduced into a trapping region (15) of the ion trapping device via a hole (14) in a first of the end-cap electrodes (12) and are retarded by application of a DC retarding voltage to the second of the end-cap electrodes (13). The retarding voltage is removed when the retarted ions are about to change their direction of motion towards the first end-cap electrode (12), and an ion trapping field is established by applying a radio frequency voltage to the ring electrode (11) when the ions are inside the ion trapping device.

7 Claims, 2 Drawing Sheets

METHOD OF TRAPPING IONS IN AN ION TRAPPING DEVICE

FIELD OF THE INVENTION

The present invention relates to a method of effectively trapping ions produced external to an ion trapping device, namely the quadrupole ion trap.

BACKGROUND OF THE INVENTION

The quadrupole ion trap was initially described by Paul et al. in U.S. Pat. No. 2,939,952 and normally consists of three electrodes; a ring electrode and two end-cap electrodes one on each side of the ring electrode. The electrodes all have rotationally-symmetric hyperbolic surfaces and are aligned on the same axis. The electrodes enclose a trapping region and a radio-frequency (RF) voltage is normally applied to the ring electrode to establish a trapping field. A variety of quadrupole ion traps, having stretched geometries or having hyperbolic surfaces with inclined asymptotes, are used in commercial mass spectrometers which utilize the quadrupole ion trap as an ion trapping device. Recent use of external ion sources coupled to the quadrupole ion trap have enabled access to a wide range of applications, such as liquid chromatography and matrix-assisted laser desorption/ionization (MALDI). The ions produced by these external ion sources have a range of initial ion energies at the sample surface, or in the sample ionization region. Problems arise due to the fact that a quadrupole ion trap operating at a high RF voltage will only accept ions which arrive at the entrance hole in one of the electrodes within a narrow phase range of the RF voltage. Ions arriving outside this phase range are either repelled before they enter the entrance hole, or strike the surface of the electrode due to acceleration by the high RF voltage after they have entered the entrance hole.

In the case of the MALDI ion source, ions with different masses are produced from a mixture of sample and matrix, which evaporates and helps ionization of the sample after irradiation by a laser pulse. The ions have different energies as well as different masses, but have the same type of velocity distributions centred on a velocity of several hundred m/s. Consequently, ions having different masses have energies proportional to their masses and ions with the highest mass have the widest energy distribution. For example, ions of mass 10,000 Da, having a maximum velocity of 1200 m/s for their velocity distribution, have energies up to 75 eV, while ions of mass 1000 Da, with the same velocity distribution, have a maximum energy of only 0.75 eV. It becomes increasingly difficult to trap ions having higher masses because the trapping pseudo-potential produced by the RF voltage is inversely proportional to the ion mass, as described in a standard text book on the quadrupole ion trap; for example, "Quadrupole Storage Mass Spectrometry, R. E. March and R. J. Hughes, John Wiley & Sons, 1989, p.77". Thus, a higher RF voltage is required to trap ions of higher mass resulting in narrower acceptance parameters for the RF phase and therefore lower trapping efficiency.

An attempt to overcome these difficulties was made by V. M. Doroshenko et al. and is described in U.S. Pat. No. 5,399,857. The described technique uses an increasing RF voltage, normally which is a linearly increasing RF and starts from zero at the time of ion creation. The RF voltage is initially low enough to allow the ions to enter the trapping region and increases as the ions penetrate deeper into the trapping region. When the ions approach the electrode surface at the other side of the trapping region, the increased RF voltage will already have established a trapping field which is sufficiently strong to trap the ions, and prevent them from being lost by hitting the electrode surface. As described in U.S. Pat. No. 5,399,857, if the ions are generated close to the entrance hole, the initial RF voltage experienced by the ions will be very small because the time required for the ions to enter the trapping region is short compared to the time needed to reach the other side of the trapping region. However, most external ion sources have a relatively long flight path and so the ions require a longer time to enter the trapping region. In this case, the ions experience a relatively high RF voltage at the entrance hole, preventing them from being trapped with high efficiency.

It is an object of the invention to provide a method of trapping ions in an ion trapping device which alleviates the above-mentioned problems.

SUMMARY OF THE INVENTION

Accordingly, the invention provides a method of trapping ions in an ion trapping device having a ring electrode and two end-cap electrodes, the method comprising:

(a) forming sample ions in an ion source external to said ion trapping device, (b) introducing said ions into said ion trapping device through a hole at the centre of a first said end-cap electrode, (c) retarding said ions by applying to a second said end-cap electrode a retarding voltage relative to said first end-cap electrode and said ring electrode, said retarding voltage being applied before said ions have entered the ion trapping device through said hole, (d) removing said retarding voltage when said ions are about to change their direction of motion towards said first end-cap electrode, and (e) establishing an ion trapping field quickly by abruptly applying a radio frequency voltage between said ring electrode and said end-cap electrodes after said ions have been introduced into the ion trapping device.

Before the ions have entered the trapping region of the ion trapping device, the RF voltage is sufficiently small, and preferably zero, that the incident ions do not suffer the afore-mentioned repulsion or acceleration which would result in ion loss and reduce trapping efficiency. Thus, ions are free to enter the trapping region when focussed by the external ion source into the entrance hole at the centre of the first end-cap electrode.

In order to reduce the spread of arrival times of ions having a range of initial energies, it is common to accelerate the ions in the ion source using a high voltage and to decelerate the ions just before they reach the entrance hole. However, although the spread of arrival times can be reduced in this way, the ions may still have a wide range of velocities; for example from 100 m/s to 1,200 m/s after deceleration, and this gives rise to spatial spreading in the trapping region. Therefore, it is preferable to apply an offset voltage to the ion source in order to offset the initial energy of the ions and thereby reduce spatial spreading. For example, application of +24V to the sample shifts the initial energy range between 0.5 eV and 75 eV to the energy range between 24.5 eV to 99 eV and this reduces the velocity range of the ions from 12-fold to only 2-fold and reduces the spatial spread as well.

The retarding voltage applied to the second end-cap electrode is preferably a DC retarding voltage. This forms an inhomogeneous electric field in the trapping volume which reduces the ion energy. The electric field thus produced for ion retardation is roughly quadratic and the ions which have entered the trapping region will be turned back towards the first end-cap electrode at substantially the same times regardless of their energy.

One of the aims of the applied retarding voltage is to increase the time for which the ions remain inside the trapping region and to accept ions with different masses arriving at different times. Another aim is to confine the spatial spread of ions to a region at and around the centre of the trapping region To these ends, the space potential at the centre of the trapping region should be substantially the same as the sample voltage applied to the ion source, so that most of the ions will spend a substantial amount of time at or around the centre of the trapping region. The space potential at the centre of the trapping region is about one fifth of the retarding voltage applied to the second end-cap electrode. Accordingly, the method further comprises applying to said ion source an offset voltage relative to said first end-cap electrode and said ring electrode, said offset voltage having an amplitude of substantially one fifth of said retarding voltage and being applied to said ion source while said ions are being extracted from the ion source. In the above illustration, the sample voltage applied to the ion source is 24V and so, in this;case, the retarding voltage applied to the second end cap would be 120V.

Because the retarding voltage is removed when the ions being repelled are at the point where they have lost most of their energy, i.e. when they are on the point of being turned back towards the first end-cap electrode, the ions will have very low kinetic energies, making it easier to trap those ions using a lower RF voltage.

After the initial energy of the ions has been reduced and the ions are within the trapping volume, the RF voltage is applied quickly to establish the trapping field. On the application of the RF voltage the positions of the ions are very important because the vibrational energy after trapping is proportional to the square of their displacement from the centre of the trapping region. By retarding the ions using the near quadratic electric field produced by the DC retarding voltage, stated above, the vibrational energy of the trapped ions is very effectively reduced. This reduces the requirement for ion cooling, which is usually the next necessary process for the quadrupole ion trap after the trapping process. The trajectories of ions after trapping are relatively stable because the ions are far from the disturbed trapping field around the exterior of the trapping region.

It is preferable to start the RF voltage from the negative part of the voltage cycle. In this case, ions in the trapping region will begin their motion inwardly for an axial component but outwardly for a radial component. By contrast, if the RF voltage were to start from the positive part of the voltage cycle it is likely that ions having relatively high initial energies would be lost by striking the end-cap electrode because the initial direction of the movement is outwardly for the axial component.

BRIEF DESCRIPTION OF THE DRAWINGS

A quadrupole ion trapping device according to the invention is now described, by way of example only, with reference to the accompanying drawings in which.

DESCRIPTION OF PREFERRED EMBODIMENT

Figure 1:
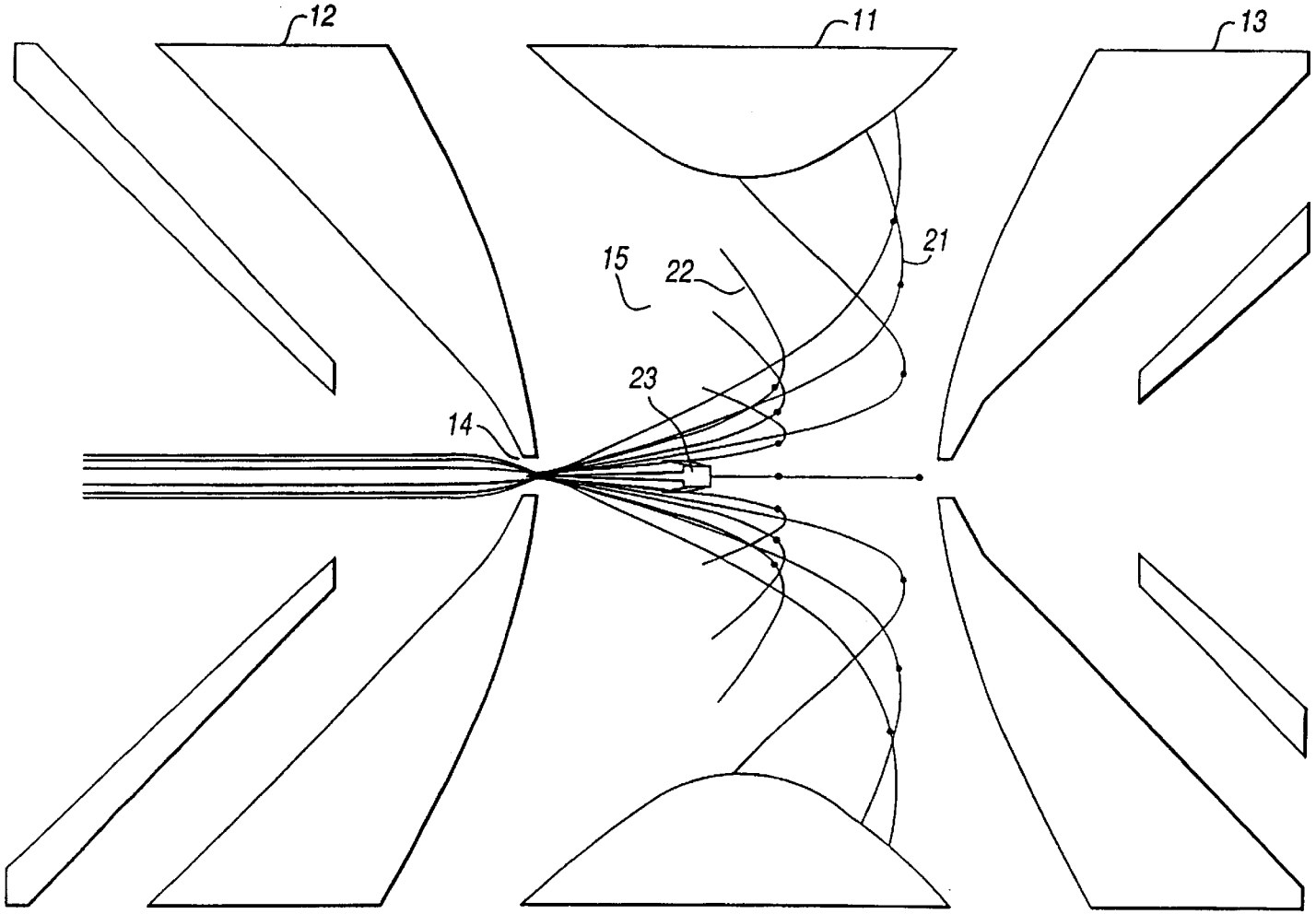
FIG. 1 is a transverse sectional view through the ion trapping device showing the trajectories of exemplary ions, and FIGS. 2(*a*), 2(*b*) and 2(*c*) illustrate the relative timings of a sample voltage, a DC retarding voltage and a RF voltage respectively applied to the ion trapping device of FIG. 1.

Referring to FIG. 1, the ion trapping device comprises a ring electrode 11, a first end-cap electrode 12 having an entrance hole 14 and a second end-cap electrode 13 enclosing a trapping region 15. A DC retarding voltage of +120V is applied to the second end-cap electrode 13, where the DC voltage is relative to the ring 11 and to the first end-cap electrode 12. A sample voltage of +24V is used, this being one-fifth of the DC voltage applied to end-cap electrode 13. The trajectories of the ions having initial energies 75 eV, 20 eV and 0.5 eV, 21, 22 and 23 respectively, with different angles of emission from the sample surface are depicted. The initial energies correspond to the initial velocities of 1,200 m/s, 620 m/s and 100 m/s, respectively. Each trajectory has a dot which represents the position of the associated ion at the same fixed time following its creation, this time being chosen to coincide with the change in direction of motion towards the entrance hole of a 75 eV on-axis ion. Removing the DC voltage at or about this time provides the efficient reduction of energies for ions with different initial energies. The trajectories shown are calculated without the application of the RF voltage. The exact trajectories differ from those shown after the application of the RF voltage.

Figure 2:
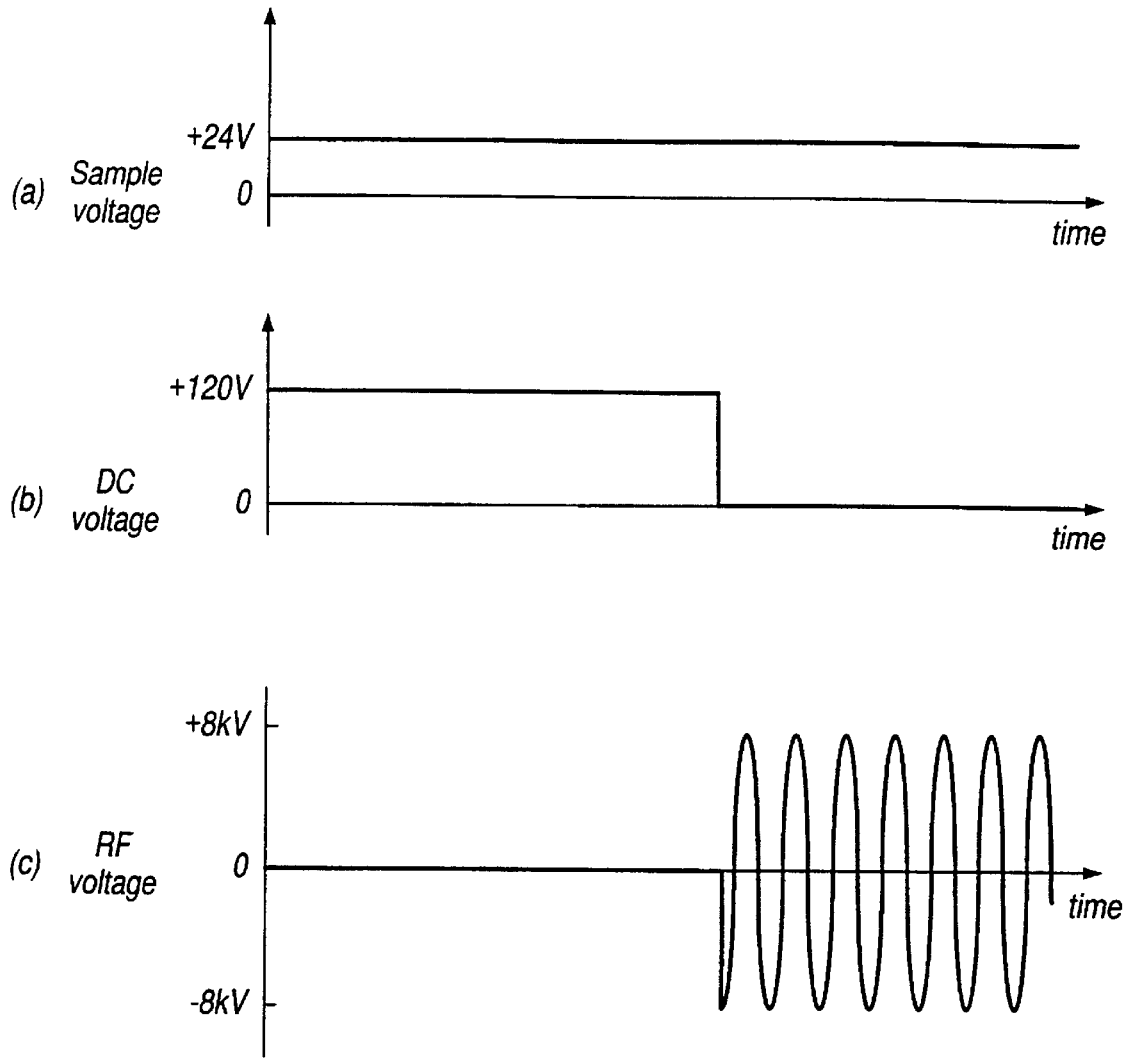

FIGS. 2(*a*), 2(*b*) and 2(*c*) illustrate the timings of the sample voltage, the DC voltage and the RF voltage respectively. In the case of a MALDI ion source the sample voltage must be established before laser irradiation and must be maintained until the extraction of ions in front of the sample surface has finished. Normally, the sample voltage is a constant voltage, but the amplitude depends on the mass range to be trapped during each analysis cycle. The DC voltage must be applied before the first ions, the lightest ions, arrive at the entrance hole and is kept constant until the proper time to remove it. The RF voltage is applied quickly starting from the negative part of the voltage cycle in this embodiment. If the ions all have the same mass it is preferable to remove the DC retarding voltage from the second end-cap electrode 13 and simultaneously to apply the RF voltage to the ring electrode 11, as illustrated by FIGS. 2(*b*) and 2(*c*). In practice timing of the RF voltage may be varied according to the mass range to be trapped to ensure that the ions of interest are inside the trapping region when the RF voltage is applied. Therefore, the time at which the RF voltage is applied may be close to, but sometimes different from, the time at which the DC voltage is removed.

In the described embodiment it has been assumed that the ions to be trapped are positive ions; alternatively, negative ions could be trapped by reversing the polarity of the applied voltages.

What is claimed is:

1. A method of trapping ions in an ion trapping device having a ring electrode and two end-cap electrodes, the method comprising:

(a) forming sample ions in an ion source external to said ion trapping device, (b) introducing said ions into said ion trapping device through a hole at the centre of a first said end-cap electrode, (c) retarding said ions by applying to a second said end-cap electrode a retarding voltage relative to said first end-cap electrode and said ring electrode, said retarding voltage being applied before said ions have entered the ion trapping device through said hole, (d) removing said retarding voltage when said ions are about to change their direction of motion towards said first end-cap electrode, and (e) establishing an ion trapping field quickly by abruptly applying a radio frequency voltage between said ring electrode and said end-cap electrodes after said ions have been introduced into the ion trapping device.

2. A method as set forth in claim 1 further comprising applying to said ion source an offset voltage relative to said first end-cap electrode and said ring electrode, said offset voltage having an amplitude of substantially one fifth of said retarding voltage and being applied to said ion source while said ions are being extracted from the ion source.

3. A method as set forth in claim 1, wherein said retarding voltage has a magnitude sufficient to retard ions having the maximum initial energy.

4. A method as set forth in claim 1, wherein said retarding voltage is constant before being removed.

5. A method as set forth in claim 1, wherein said radio-frequency voltage is zero until said ions have entered said ion trapping device.

6. A method as set forth in claim 1, wherein said radio-frequency voltage starts from the negative part of the voltage cycle for positive ions to be trapped.

7. A method as set forth in claim 1, wherein said radio-frequency voltage starts from the positive part of the voltage cycle for negative ions to be trapped.

* * * * *